US005508003A

United States Patent [19]

Rancourt et al.

[11] Patent Number: 5,508,003

[45] Date of Patent: Apr. 16, 1996

[54] METALLIC MATERIAL WITH LOW MELTING TEMPERATURE

[75] Inventors: James Rancourt; Larry T. Taylor, both of Blacksburg, Va.

[73] Assignees: The Center for Innovative Technology, Herndon; Virginia Tech Intellectual Properties; Virginia Polytechnic Institute and State University, both of Blacksburg, all of Va.

[21] Appl. No.: 320,902

[22] Filed: Oct. 11, 1994

Related U.S. Application Data

[63] Continuation-in-part of Ser. No. 199,875, Feb. 22, 1994, and a continuation-in-part of Ser. No. 22,118, Feb. 25, 1993, Pat. No. 5,391,846.

[51] Int. Cl.$^6$ ..... C22C 28/00

[52] U.S. Cl. ..... 420/555

[58] Field of Search ..... 420/555; 200/233, 200/234

[56] References Cited

U.S. PATENT DOCUMENTS 3,462,573 3/1995 Rabinowitz et al. ..... 200/152

FOREIGN PATENT DOCUMENTS 60-135548 3/1995 Japan ..... 420/555

*Primary Examiner*—John Sheehan

*Attorney, Agent, or Firm*—Whitham, Curtis, Whitham, & McGinn

[57] ABSTRACT

A gallium-indium-zinc-copper metallic material has been found to exhibit many of the advantageous properties of mercury, such as electrical conductivity, fluidity, and high vaporization temperature. The metallic material is formulated by combining individual components in the presence of aqueous base, isolating the metallic phase, and heating the metallic combination. The metallic material is formulated to have sufficient quantities of each of the individual components such that the metallic material has a solidification temperature below 0° C.

4 Claims, No Drawings

METALLIC MATERIAL WITH LOW MELTING TEMPERATURE

CROSS-REFERENCE TO RELATED APPLICATIONS

This patent application is a continuation-in-part (CIP) application of the co-pending patent application having U.S. Ser. No. 08/199,875 filed Feb. 22, 1994, and is also a CIP of the patent application having U.S. Ser. No. 08/022,118 filed Feb. 25, 1993, now U.S. Pat. No. 5,391,846. The complete contents of both co-pending applications is herein incorporated by reference.

DESCRIPTION

BACKGROUND OF THE INVENTION

1. Field of the Invention

The invention is generally related to a less toxic or non-toxic substitute for mercury which has utility in a wide variety of applications, and particularly in electrical switch and sensor applications. More specifically, the invention is directed to a gallium based metallic material which will behave like mercury metal at both high and low temperatures.

2. Description of the Prior Art

Mercury is used extensively in switches and sensors. In a common switch application, liquid mercury is positioned inside a fluid tight housing into which a pair of spaced electrodes extend. Depending on the physical orientation of the housing, the liquid mercury can provide a conductive pathway between the electrodes or be positioned such that there is an open circuit between the electrodes. An important physical attribute of mercury is that it remains fluid throughout a wide temperature range. This attribute allows mercury to be used in many different environments and in environments with constantly changing temperature parameters. Another important physical attribute of mercury is that it has significant surface tension and does not wet glass, metal or polymer surfaces. However, mercury is toxic to humans and animals. As such, finding less toxic or non-toxic alternatives to mercury that have comparable performance characteristics would be beneficial.

Gallium alloys have been proposed as a substitute liquid metal for mercury in electrical switch applications in both U.S. Pat. No. 3,462,573 to Rabinowitz and in Japanese Patent Application Sho 57-233016 to Inage et al. U.S. Pat. No. 3,462,573 to Rabinowitz suggests the use of gallium alone, as well as binary, ternary and quaternary alloys of gallium, in electrical switches. Rabinowitz indicates that adding elements to gallium can be used as a means to lower the freezing point or solidification temperature of the combination below the freezing point of gallium alone (29.7° C.). The metals selected must be soluble in gallium and include indium, tin, copper, silver, gold, palladium, iron, germanium, zinc, calcium, nickel, cadmium, and platinum. Particularly preferred gallium alloys identified in Rabinowitz include gallium-indium-tin alloys. Japanese Patent Application Sho 57-233016 to Inage et al. discloses that using 1–3.5% silver in combination with gallium-indium-tin alloys can lower the solidification temperature of the alloy close to 0° C.

It would be advantageous to provide a non-mercury metallic material which has a solidification temperature below 0° C., and which does not include heavy metals which pose potential health hazards such as mercury, cadmium, lead, chromium, or tin.

SUMMARY OF THE INVENTION

It is an object of this invention to provide a metallic material which has a solidification temperature below 0° C. that is comprised of gallium, indium, zinc and copper.

According to the invention, gallium, indium, zinc and copper are combined in specific weight percentage proportions to form a homogenous metallic material that has a solidification temperature below 0° C. The metallic material has many of the same attributes as mercury, such as high vaporization temperature (>2000° C.), similar flow characteristics, and the like. Therefore, the gallium based metallic materials can be used as a substitute for mercury in a wide variety of applications including use in an electrical switch or sensor, use in temperature sensors and thermometers, use in pressure sensors or pressure activated switches, use in pumps and filters, use in liquid mirror telescopes, use in fluid unions, use in slip rings, use as a dental amalgam, and in a wide variety of other uses.

DETAILED DESCRIPTION OF THE PREFERRED EMBODIMENTS OF THE INVENTION

Metallic materials or alloys which contain gallium, indium, zinc, and copper which have solidification temperatures below 0° C. have been prepared. These metallic materials have the following attributes: electrical conductivity (can conduct beth AC and DC current); solidification temperature near −10° C.; very high boiling point; very low vapor pressure at room temperature; and similar flow characteristics to mercury. These metallic materials were prepared by weighing out each component individually, and adding the component to a single Erlenmeyer flask. Gallium was first weighed into the flask in the amount desired. The precise amount of each additional component was determined according to the following equations:

$$100 \times \frac{\text{Wt. of Ga measured}}{\text{\% Ga desired in material}} = \text{Total Wt. of Material Desired}$$

$$\frac{(\text{\% Additional Element})\,(\text{Total Wt. Desired})}{100} = \text{Wt of Element Measured}$$

After introduction of all components into the flask, aqueous base was added to the flask. Good results were achieved using 50 mL of 30% NaOH; however, it should be understood that other aqueous bases could be used in the practice of this invention such as KOH, $NH_4OH$, and the like. The primary function of the aqueous base is to clean the metals and enable the pure metals to interact. The liquid base also provides an inert environment for the metals. Gallium and indium dissolve in aqueous base, but zinc and copper do not. It has been observed that when the combination of metals and aqueous base are stirred in a loosely stoppered flask at room temperature (15°–35° C.) for short periods of time (e.g., 5–30 minutes) the contents of the flask become liquid in character and have both an aqueous phase and a metallic phase.

The metallic phase includes the "metallic material" or "alloy" of of the metallic layer, transferring the metallic component to a test tube, and subjecting the metallic component to a heat treatment. Preferably, the metallic component is heated under a nitrogen atmosphere, or similar inert environment, so that the metallic material does not become oxidized.

The heating schedule employed was a follows: 8° C./min to 100° C.; hold at 100° C. for 10 minutes, increase temperature at 8° C./min to 450° C.; hold for 4 hours at 450° C.; then cool to room temperature at approximately 3° C. The heat treatment can likely be varied in the practice of this invention. For example, higher temperatures for shorter periods of time, or lower temperatures for longer periods of time may be used to make the quatemary metallic material of this invention. All that is required is for the heat treatment to be sufficient for forming a metallic material or alloy from the combined metallic components. After cooling to room temperature, aqueous base is preferably added to the metallic material to remove any black oxide film that might have formed during handling of the material.

The heat treatment yields both a liquid product and a solid product. The mass ratio of the products depends on the composition of the formulating mixture. The amount of each product can be ascertained by first drawing off the metallic liquid into a previously tared vial followed by weighing. The solid residue is then isolated, dried, and independently weighed. For example purposes, Table 1 provides the conditions used for synthesis of the mercury replacement material according to this invention along with the approximate weights for the components.

TABLE 1

| Typical Conditions for Synthesis of Mercury Replacement Material | |
|---|---|
| Weight of Ga | 38 g |
| Weight of In | 11 g |
| Weight of Zn | 0.5 g |
| Weight of Cu | 1.0 g |
| 50 mL of 30% Aqueous base | |
| Pre-purified Nitrogen gas | |
| Heat at 300–450° C. | |
| Liquid Product | 45 g |
| Solid Residue | 5 g |

Table 2 presents the theoretical weight percent values for a metallic material produced with the components presented in Table 1.

TABLE 2

| Theoretical Values | |
|---|---|
| Component | Percentage |
| Ga | 75.1 |
| In | 21.81 |
| Zn | 1.00 |
| Cu | 2.00 |

Table 3 presents the elemental analysis averages from a duplicate study of five liquid products (A–E) prepared according to the above technique with the composition presented in Table 1, as well as the elemental analysis of the residual solids (AA) isolated from liquid product A.

TABLE 3

| | Elemental Analysis | | | | | |
|---|---|---|---|---|---|---|
| Component | A | AA | B | C | D | E |
| Ga | 76.8 | 63.6 | 77.5 | 73.6 | 76.8 | 76.7 |
| In | 22.5 | 9.69 | 21.1 | 25.3 | 22.3 | 22.5 |
| Zn | 0.98 | 1.12 | 0.98 | 0.95 | 0.98 | 0.96 |
| Cu | 0.01 | 20.3 | 0.0003 | 0.002 | 0.24 | 0.15 |
| Total | 100.29 | 94.705 | 99.0 | 99.752 | 100.0 | 100.205 |

Table 4 presents the solidification temperature temperature for the five liquid products identified in Table 3.

TABLE 4

| | Solidification temperature Measurements | | | | |
|---|---|---|---|---|---|
| | A | B | C | D | E |
| Solid. Temp. | −10° C. | −9° C. | −10° C. | −10° C. | −11° C. |

Tables 1–4 demonstrate that quaternary metallic materials, which include gallium, indium, zinc, and copper in specific weight percent combinations, can be prepared in a manner which produces a product having a solidification temperature below 0° C. The preferred metallic materials of this invention will have a solidification temperature ranging between −1° C. and −15° C. Table 3 demonstrates that only a very small percentage of copper starting material becomes part of the metallic material, and the remainder is separated as part of the residual solids. However, tests have demonstrated that including the copper in the quaternary metallic material is important to achieve optimum solidification temperature suppression. Tables 2 and 3 also show that the weight percentage of zinc in the metallic material is close to the theoretical value and that the weight percentage of gallium is higher than the theoretical value. This is due to much of the copper component not becoming part of the metallic material.

The weight percentages of the components in an Ga-In-Zn-Cu metallic material according to this invention may vary from those achieved with the products A–E in Table 3, yet still result in an metallic material with a solidification temperature below 0° C. Varying the weight percentages of the four components in the final metallic material is achieved by adjusting the relative weights of the individual components when they are combined in the aqueous base. Preferably, the weight percentage of each component in the Ga-In-Zn-Cu metallic material falls within the ranges specified in Table 5.

TABLE 5

| | Weight Percentage Range wt % |
|---|---|
| Ga | 70–80 |
| In | 20–29 |
| Zn | 0.05–5 |
| Cu | 0.0001–1 |

Most preferably, the weight percentage of each component in the Ga-In-Zn-Cu metallic material falls with the ranges specified in Table 6.

TABLE 6

| | Preferred Weight Percentage Range wt % |
|---|---|
| Ga | 72–78 |
| In | 20–26 |
| Zn | 0.1–1 |
| Cu | 0.0001–.3 |

The Ga-In-Zn-Cu metallic material has many of the same attributes as mercury, such as high vaporization temperature (>2000° C.), similar flow characteristics, and the like. Therefore, the gallium based metallic materials can be used as a substitute for mercury in a wide variety of applications including use in an electrical switch or sensor, use in temperature sensors and thermometers, use in pressure sensors or pressure activated switches, use in pumps and filters, use in liquid mirror telescopes, use in fluid unions, use in slip rings, use as a dental amalgam, and the like.

While the invention has been described in terms of its preferred embodiments, those skilled in the art will recognize that the invention can be practiced with modification within the spirit and scope of the appended claims.

We claim:

1. A metallic material having a solidification temperature below 0° C. which comprises gallium, indum, zinc and copper wherein said gallium constitutes between 70 and 80 wt %, said indium constitutes between 20 and 29 wt %, said zinc constitutes between 0.05 and 5 wt %, and said copper constitutes between 0.0001 and 1 wt %.

2. The metallic material of claim 1 wherein said gallium constitutes between 72 and 78 wt %, said indium constitutes between 20 and 26 wt %, said zinc constitutes between 0.1 and 1 wt %, and said copper constitutes between 0.0001 and 0.3 wt %.

3. A metallic material having a solidification temperature below 0° C. which consists essentially of gallium, indium, zinc, and copper, wherein said gallium constitutes between 70 and 80 wt %, said indium constitutes between 20 and 29 wt %, said zinc constitutes between 0.05 and 5 wt %, and said copper constitutes between 0.0001 and 1 wt %.

4. The metallic material of claim 3 wherein said gallium constitutes between 72 and 78 wt %, said indium constitutes between 20 and 26 wt %, said zinc constitutes between 0.1 and 1 wt %, and said copper constitutes between 0.0001 and 0.3 wt %.

* * * * *